United States Patent [19]

Taupin

[11] 4,160,514

[45] Jul. 10, 1979

[54] DEVICE FOR FLUIDIZING AND DISCHARGING DIVIDED MATERIAL

[76] Inventor: Jean-Paul Taupin, Le Vivier, 53130 Urzy, France

[21] Appl. No.: 748,904

[22] Filed: Dec. 9, 1976

[30] Foreign Application Priority Data

Dec. 16, 1975 [FR] France ..... 75 38506

[51] Int. Cl.[2] ..... B65G 33/14

[52] U.S. Cl. ..... 222/228; 222/413

[58] Field of Search ..... 222/228, 236, 413, 241

[56] References Cited

U.S. PATENT DOCUMENTS

| | | | |
|---|---|---|---|
| 2,228,421 | 1/1941 | Taylor | 222/228 |
| 3,037,713 | 6/1962 | Carrol | 222/228 X |
| 3,138,300 | 6/1964 | Rintala | 222/228 |
| 3,223,290 | 12/1965 | Schuld | 222/228 |
| 3,587,938 | 6/1971 | Brown | 222/228 |

FOREIGN PATENT DOCUMENTS

| | | | |
|---|---|---|---|
| 349850 | 6/1937 | Italy | 222/413 |

*Primary Examiner*—Joseph J. Rolla
*Assistant Examiner*—Frederick R. Handren
*Attorney, Agent, or Firm*—Weingarten, Maxham & Schurgin

[57] ABSTRACT

A device for unloading silos of divided material such as flour includes a rotary shaft on which axially spaced, radial members are carried. The members support flexible elongate elements which have a length no greater than the distance between the outer edges of the radial members and the walls of the silo.

Rotation of the shaft causes the material to be fluidized and to pass down and out the silo without preventing simultaneous filling of the silo. The outlet from the silo is at its bottom end and discharge is achieved by helical elements which may be driven by the same motor as the rotary shaft.

9 Claims, 4 Drawing Figures

DEVICE FOR FLUIDIZING AND DISCHARGING DIVIDED MATERIAL

This invention relates to a device for fluidising and discharging divided material from a silo.

For emptying silos with a flat base it is known to use devices which include a rotatably driven chain of which one of its ends is free to extend to the periphery of the silo and to roll up about the axis of rotation.

It has been established by our trials that a chain can not be used successfully for the discharge of divided or pulverulent products. If the chain is disposed at a certain height to avoid it coming into contact with the base, it follows that the chain adopts a curved position under its own weight and the product which lies under the chain is not discharged.

Moreover, if the chain rests on the base during rotation considerable noise and premature wearing out of the chain results, which requires that the chain is frequently replaced and this is very troublesome in causing the silo to be put out of action.

The chain due to its displacement at the moment of stopping has a tendency to roll up on itself to cause knots which it is impossible to untie without emptying the silo.

Moveover it is also known with flat base silos to use a flexible element to replace the chain to avoid the above disadvantages.

One such element allows the formation of a mixture of the product with the ambient air so that fluidisation of the divided product is obtained thereby assuring discharge more easily.

Silos with conical or pyramidal bases enable, as compared to silos with flat bases, simultaneous filling up and emptying without allowing a part of the product first stocked in the silo to remain.

Furthermore it is known that a device with the conical base can comprise a smooth shaft on which is fixed two resilient arms, but one such arrangement can not prevent the fact that the product is run off principally along this shaft thus disturbing the emptying of the silo.

The device according to the invention has for an object to achieve emptying which is not exclusively central and to enable simultaneous refilling of the silo.

According to the invention a device for fluidising and discharging divided material from a silo comprises a rotatable shaft arranged to extend internally of the base of the silo, hub members carried for rotation on the shaft and extending in successive spaced planes perpendicular to the axis of the shaft, and at least one elongate flexible and deformable element attached to each of the hub members, the elements having a length no greater than the radial distance between the outer edge of the associated hub member and the wall of the base of the silo.

Figure 1:
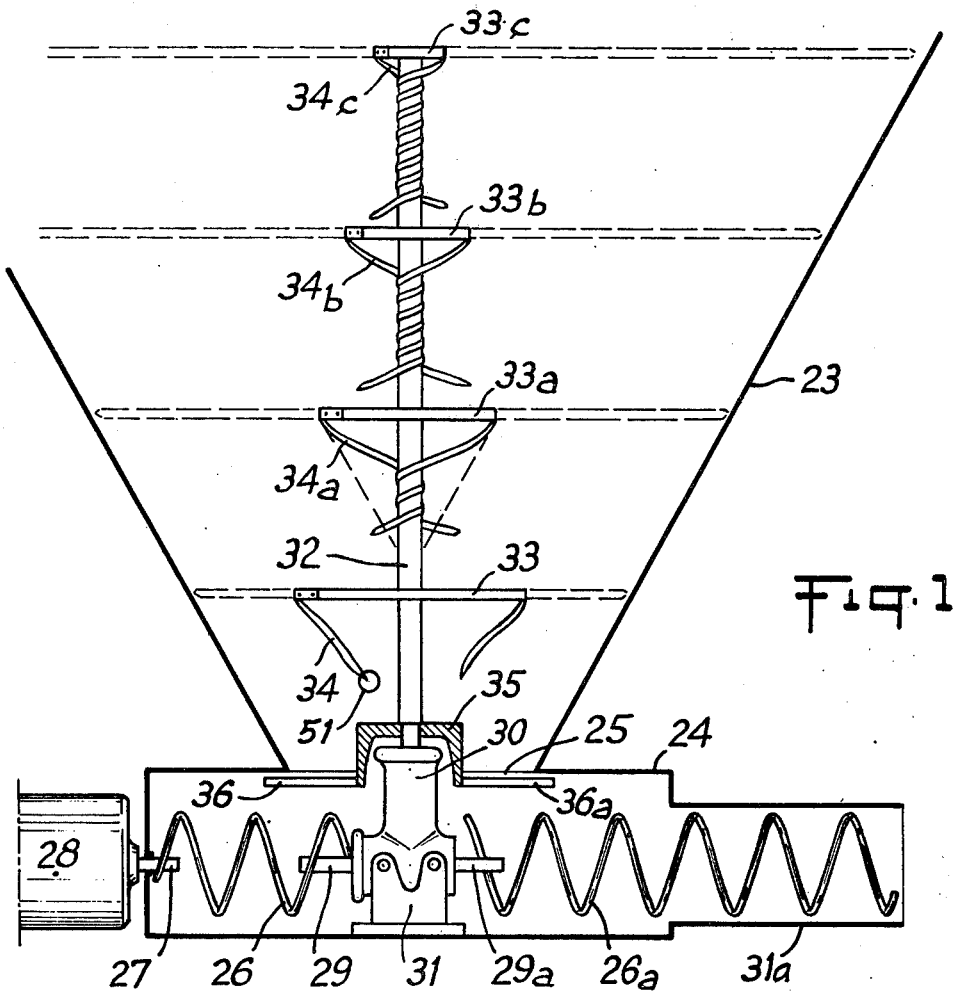
Figure 2:
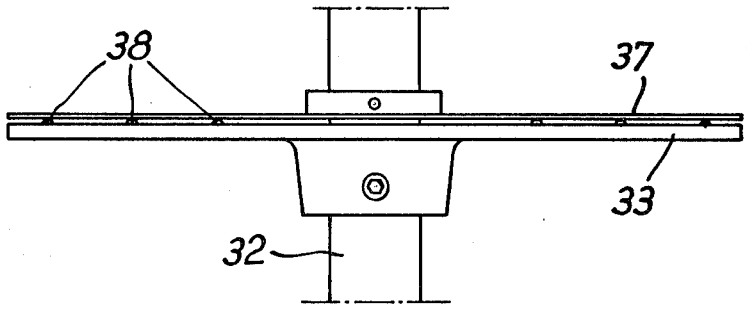
Figure 3:
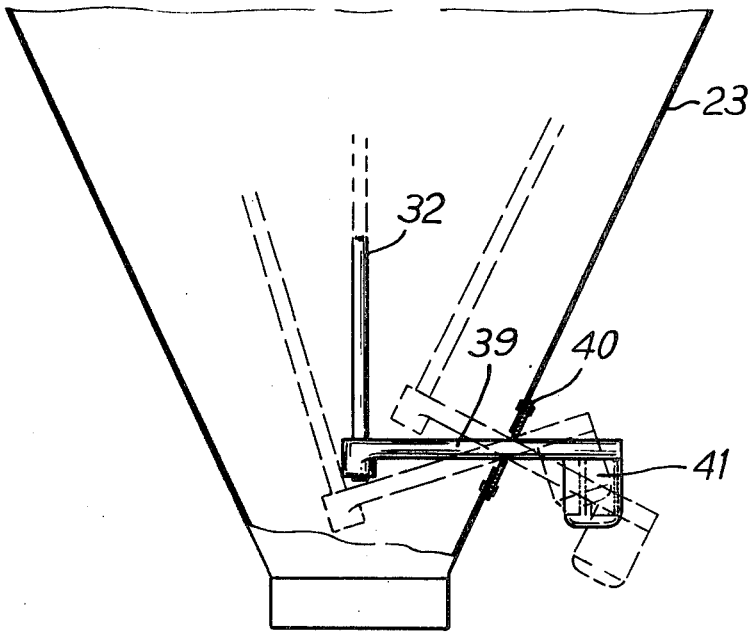
Figure 4:
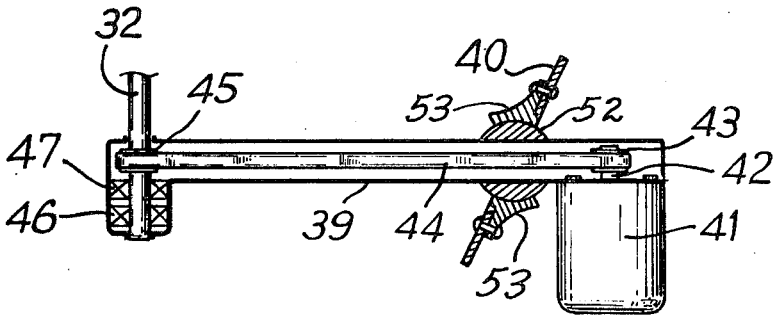

Further features of the invention will appear from the following description of an embodiment of the invention given by way of example only and with reference to the drawings in which:

FIG. 1 is a sectional elevation of a device according to the invention fitted to a silo with a conical base, FIG. 2 is an elevation of a detail of the device of FIG. 1, FIG. 3 is a sectional elevation of a modification of the device of FIG. 1, and FIG. 4 is a sectional view of part of the modification of FIG. 3.

Referring to FIG. 1, the illustrated device is more particularly concerned with a device adapted to ensure the evacuation of the interior of a silo with a vertical axis filled with material in divided form, granular or pulverulent, for example, flour. A base 23 of the silo is in the form of a truncated cone or a pyramid with the small end downward, but it is evident that it can be of a different form, for example part spherical. Although it is not shown it is possible for the base 23 to be symmetrical or asymmetrical.

At the bottom of the base 23 of the silo is disposed a housing or trough 24 which communicates with the silo through an opening 25 and encloses a transfer member of helical spiral form which is constituted by two elements 26, 26*a*.

One of the helical elements 26 is connected at one of its ends to the output shaft 27 of a motor 28 and at the other end to a shaft 29 of transmission means 30 with right angle gearing fixed to a support 31 attached to the base of the housing 24.

At its other end 29*a* the shaft 29 is connected to the helical element 26*a* which extends with its free end into a lateral discharge duct 31*a* integral with the housing 24.

This arrangement enables the helical elements 26, 26*a* of the discharge mechanism to be disposed coaxially with the shaft 29 of the transmission 30 and directly in engagement with the shaft 29 of the transmission and driven by the motor 28 through the intermediary of the element 26. It is also possible to omit any additional transmission for driving the helical extraction means.

In the interior of the silo defined by the base 23 a rotary shaft 32 is arranged extending vertically and fixed to the output shaft of the transmission 30, the shaft 32 carrying hub members 33, 33*a*, 33*b*, 33*c* of circular form in vertically spaced planes perpendicular to the axis of the shaft 32 and on each hub member is attached two flexible, deformable elongate elements such as 34, 34*a*, 34*b*, 34*c*.

The members 33 to 33*c* can have a conical vertical section as shown in chain lines for the member 33*a*.

The elements 34, 34*a*, 34*b*, 34*c* have a length no greater than the radial distance separating the outer edge of the associated members 33, 33*a*, 33*b*, 33*c*, and the wall of the base 23. The flexible elements can include, if necessary, weights 51 at their freed ends, an example of which is shown attached to elongate element 34 in FIG. 1.

The members 33, 33*a*, 33*b*, 33*c* have different radial dimensions such that this dimension (or diameter) is at a maximum for the member 33 situated towards the bottom of the silo and progressively decreasing upwardly to reach a minimum for the member 33*c* situated at the top of the shaft 32. It will also be seen that the radial width of the members is not greater than the length of the associated flexible elements.

Under the opening 25 of the silo leading into the housing 24 of the extraction means, a member 35 is disposed which is of bell shaped form and is fixed to the bottom of the rotary shaft 32 and on which are fixed flexible elements 36, 36*a*, corresponding to the elements 34 and which are for fluidising the product at the level of the outlet and in the housing 24.

Referring now to FIG. 2, a disc 37 is located on at least one of the hub members, such as member 33, and has a diameter at least equal to that of the associated member upon which it is located. The disc is mounted freely rotatable on the hub member through rollers 38 or by equivalent means such as ball bearings.

This arrangement is for enabling the disc 37 to turn freely while it supports little product and to be fixed while it supports the mass of product located in the silo.

The device operates in the following manner:

When the device is at rest and the silo is empty, the elements 34, 34*a*, 34*b*, 34*c* hang freely from the members to which they are attached, by reason of their flexibility.

After filling the silo with the product in divided form, and at the beginning of rotation of the shaft 32 by the motor 28 through the transmission 30, the elongate elements 34, 34*a*, 34*b* 34*c* have a tendency to deploy themselves radially under the action of centrifugal force. However, by virtue of the presence of the product the longer elongate elements mounted on the hub members of the smaller radial dimension, such as element 34*c*, have a tendency to roll themselves onto the shaft 32 as shown in continuous lines in FIG. 1, to the extent that the hub members and elongate elements at the upper part, such as member 33*c*, are effectively reduced to the diameter of the hub member.

On the contrary the member 33 situated at the bottom of the silo has a relatively greater diameter and carries the shortest flexible elements 34 which are completely curled up on the member, thereby resulting in the elements having a tendency to be deployed radially quicker than the flexible elements 34*b*, 34*c* which are rolled up around the shaft 32. In this way the elements 34 at once produce fluidisation of the product at their level in the silo, then the elements 34*a* carried by the member 33*a* situated immediately above come into action and open up progressively to reach the position shown by chain lines in FIG. 1, and following in sequence the other elements 34*b* and 34*c* do likewise in going up towards the upper part of the silo.

The product thus is removed in almost horizontal layers because of the presence of the successive members 33 to 33*c* which form baffles and brake the descent of the product lengthwise of the shaft 32, the braking action being more efficient if the members 33 are provided with discs 37 capable of lying substantially fixed in relation to the rotating members.

The object of the present invention is to obtain emptying which is not effected exclusively along the shaft 32, for a large part of the extraction of the product, in order to permit a simultaneous filling of the silo.

For large flows an independent drive assembly for the unloading system can be used, the shaft 32 being driven by an assembly shown in FIGS. 3 and 4. The drive assembly is formed of a tubular member 39 pivotally mounted on a wall of the base 23 of the silo by means of a plate 40, such that the tubular member 39 extends partly internally and partly externally of the silo.

At its external end the tubular member 39 carries a motor 41 having a drive shaft 42 on which is attached a pulley 43 which is connected by a belt 44, preferably notched, to another pulley 45 which is attached to the shaft 32 carrying the flexible elements.

The assembly formed by the pulleys 43, 45 and the belt 44 is disposed internally of the tubular member 39 which is closed by a cover at its internal end.

Bearing blocks 46 and 47 give support to the shaft 32 with respect to the member 39.

The plate 40 is adjustable to enable it to be positioned in several positions relative to the silo wall, such as by means of the friction ball joint shown in FIG. 4. Ball 52 is seated in resilient members 53 fitted in the opening in silo wall 40. It would also be possible to use other angular adjustment means such as a notched ball joint. Such means as the ball joint shown permit angular movement of member 39 and maintain the member at the selected angular position.

What I claim as my invention and desire to secure by Letters of Patent of the United States is:

1. A device for fluidizing and discharging divided material from a silo comprising a rotatable shaft arranged to extend internally of the base of the silo, hub members carried for rotation on the shaft and extending in successive spaced planes perpendicular to the axis of the shaft, and at least one elongate flexible and deformable element attached to each of the hub members, the elements having a length no greater than the radial distance between the outer edge of the associated hub member and the wall of the base of the silo, and the hub members having different radial dimensions so that for the lowest member nearest the bottom of the silo the radial dimension is at a maximum and for the uppermost member nearest the top of the silo the dimension is at a minimum, and the dimensions of the intermediate hub members progressively decrease between the lowest and the uppermost members.

2. A device according to claim 1 wherein the elements are weighted.

3. A device according to claim 1 wherein the radial width of the hub members is no greater than the length of the associated flexible element.

4. A device according to claim 1 wherein the shaft supporting the hub members is driven by a motor through a transmission means.

5. A device according to claim 4, wherein the transmission means includes an input shaft and at least one other shaft, a housing located at the bottom of the silo, a helical transportation means disposed within said housing, the helical transportation means comprising first and second helical transport members, the input shaft of the transmission means being disposed coaxially with said helical transport members, the first helical transport member interconnecting the motor and the input shaft of the transmission means, and the second helical transport member being fixed to said other shaft of the transmission means.

6. A device according to claim 1 further including a discharge housing for receiving material discharged from the silo through an opening thereof and, disposed under said opening, at least one flexible elongate element fixed to a hub member attached to the rotatable shaft.

7. A device for fluidizing and discharging divided material from a silo comprising a rotatable shaft arranged to extend internally of the base of the silo, hub members carried for rotation on the shaft and extending in successive spaced planes perpendicular to the axis of the shaft, a freely rotatable disk mounted on at least one of the hub members, and at least one elongate flexible and deformable element attached to each of the hub members, the elements having a length no greater than the radial distance between the outer edge of the associated hub member and the wall of the base of the silo.

8. A device for fluidizing and discharging divided material from a silo comprising a rotatable shaft arranged to extend internally of the base of the silo, hub members carried for rotation on the shaft and extending in successive spaced planes perpendicular to the axis of the shaft, and at least one elongate flexible and deformable element attached to each of the hub members, each element having a length no greater than the radial distance between the outer edge of the associated hub member and the wall of the base of the silo, the rotatable shaft being driven by a drive assembly comprising a tubular member having disposed therein two pulleys interconnected by a belt and connected respectively to the rotatable shaft and to a motor shaft, the tubular member being fixed to the wall of the base of the silo by an angularly adjustable member.

9. A device according to claim 8 wherein part of the tubular member extends to the exterior of the silo and a motor is fixed to said part, the shaft of the motor carrying one of the pulleys.

* * * * *